United States Patent [19]

Giles, Jr.

[11] Patent Number: 4,662,953

[45] Date of Patent: May 5, 1987

[54] CREEP RESISTANT COLD-ROLLED AND ANNEALED STEEL SHEET AND STRIP

[75] Inventor: Philip M. Giles, Jr., Bethlehem, Pa.

[73] Assignee: Bethlehem Steel Corporation, Bethlehem, Pa.

[21] Appl. No.: 754,900

[22] Filed: Jul. 15, 1985

[51] Int. Cl.[4] ..... C21D 8/02

[52] U.S. Cl. ..... 148/36; 420/126; 420/88

[58] Field of Search ..... 75/123 D, 123 M, 124; 148/36

[56] References Cited

U.S. PATENT DOCUMENTS 2,280,769 4/1942 Comstock ..... 148/36

4,398,950 8/1983 Gupta et al. ..... 75/123 M

FOREIGN PATENT DOCUMENTS 55-24927 2/1980 Japan ..... 75/123 M

*Primary Examiner*—L. Dewayne Rutledge

*Assistant Examiner*—Deborah Yee

*Attorney, Agent, or Firm*—William B. Noll

[57] ABSTRACT

A cold-rolled, annealed and coated steel sheet or strip characterized by (1) a high degree of creep resistance, as measured by excellent performance in a sag deflection test when subjected to temperatures up to 1500° F. for times in excess of 100 hours, and (2) a composition consisting essentially of, by weight %:

| | |
|---|---|
| Carbon | 0.05–0.15 |
| Manganese | 0.50 max. |
| Phosphorus | 0.04–0.15 |
| Sulfur | 0.03 max. |
| Silicon | 0.10 max. |
| Aluminum | 0.08 max. |
| Titanium | 0.20–0.50 |
| Iron | balance* |

*except for the inclusion of normal impurities such as Cu, Ni, Cr, Mo, N, O

2 Claims, 1 Drawing Figure

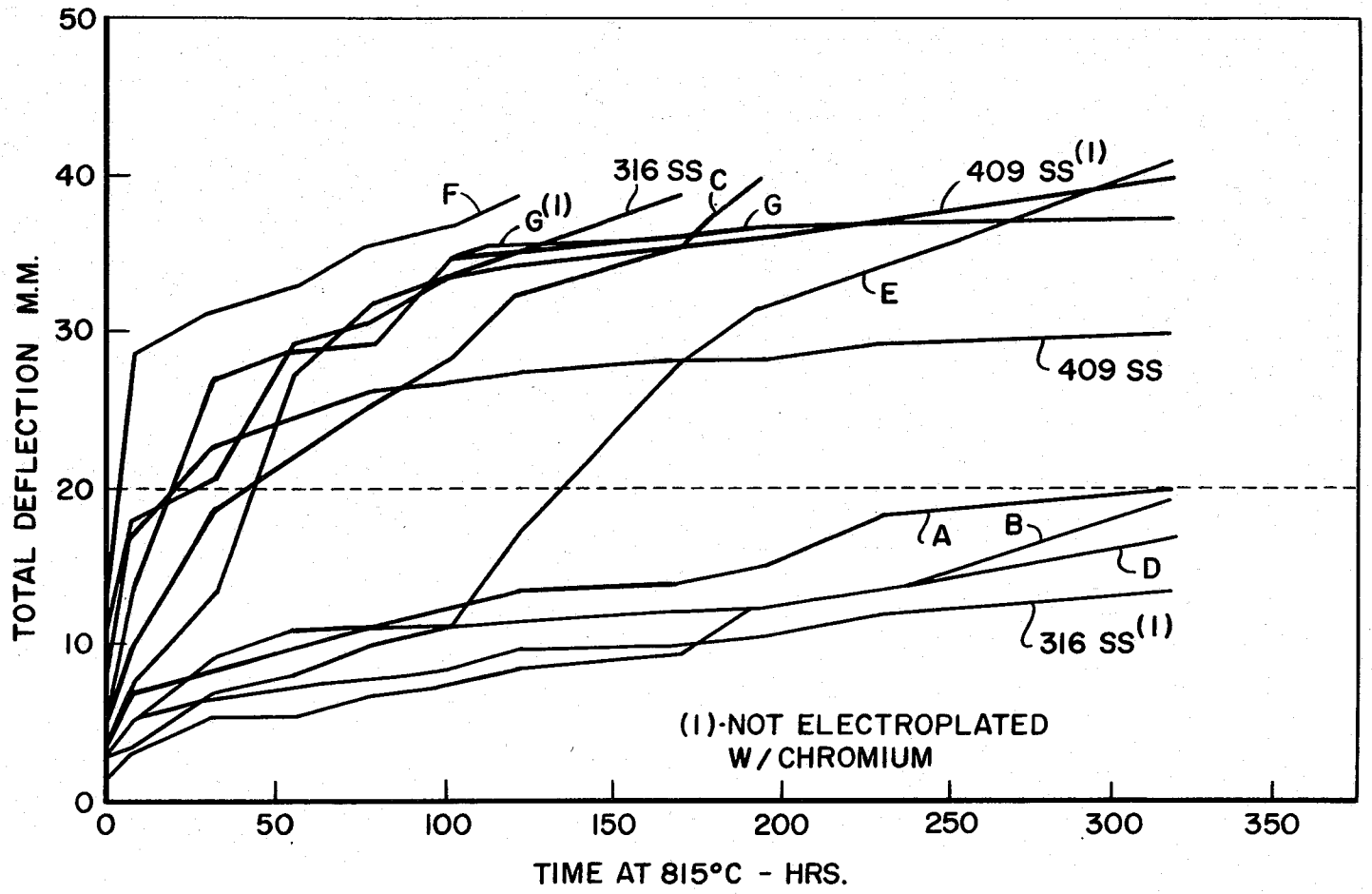
TOTAL DEFLECTION M.M.
50
40
30
20
10
0
0
50
100
150
200
250
300
350
TIME AT 815°C - HRS.
409 SS(1)
409 SS
316 SS
316 SS(1)
F
G(1)
G
C
E
A
B
D
(1)-NOT ELECTROPLATED W/CHROMIUM

CREEP RESISTANT COLD-ROLLED AND ANNEALED STEEL SHEET AND STRIP

BACKGROUND OF THE INVENTION

This invention relates to a cold-rolled and annealed steel strip, preferably having a metallic coating thereon to impart corrosion protection to such strip, and exhibiting a high degree of creep resistance.

The automotive industry has in recent years sought to improve the performance of automobiles by decreasing the amount of gasoline consumed by automobiles. One aspect of its program of improved performance was to reduce such consumption through a reduction in weight of the automobiles. To compensate for the reduction in weight, by the use of thinner parts, for instance, it was and is necessary to use higher strength materials. By way of example, thinner higher strength low alloy steels are now being substituted for low-carbon, cold-rolled steel. However, since the demands on an automotive component vary due to the component's exposure to high temperatures and/or corrosive conditions, the search for new materials has become very scientific and quite precise. The search for improved materials for automotive exhaust systems represents one of the most challenging needs in the automotive industry.

The investigation which led to this invention was undertaken with the goal of developing a sheet steel having improved high temperature strength, and when coated with a metallic coating being resistant to oxidation/corrosion when subjected to the cyclic conditions of an automotive exhaust system at temperatures ranging up to 1500° F.

Two steels which have enjoyed some commercial success are Type 409 stainless steel (409SS), and an aluminum coated, titanium-stabilized sheet steel. 409SS, while characterized as a lean stainless steel, i.e. only about 10.5% by wt. chromium, balance essentially iron, it is nevertheless a stainless steel for which a premium is extracted. The titanium-stabilized sheet steel lacked sufficient deformation resistance at elevated temperatures. Even a later innovation on the latter steel by Gupta et al, U.S. Pat. No. 4,398,950, was not sufficient to meet the demands herein stated.

It was not until the present invention that titanium, phosphorus and carbon were combined in critical proportions and quantities in steel, and that the role of Ti-P-C concentrations were understood in providing microstructural stability and creep resistance to such steel. This discovery will be described in detail in the specification which follows.

SUMMARY OF THE INVENTION

In accordance with the present invention, there is provided a cold-rolled and annealed steel sheet or strip having a high resistance to deformation. This is achieved with a steel whose composition is controlled within the following limits, by wt. %:

| | |
|---|---|
| Carbon | 0.05–0.15 |
| Manganese | 0.50 max. |

-continued

| | |
|---|---|
| Phosphorus | 0.04–0.15 |
| Sulfur | 0.03 max. |
| Silicon | 0.10 max. |
| Aluminum | 0.08 max. |
| Titanium | 0.20–0.50 |
| Iron | essentially the balance |

Such alloys, through careful control on the relationship of the elements Ti-P-C, give sufficient precipitate density while preventing diffusion of excess titanium. As a result, the alloys in the form of cold-rolled sheet and strip exhibit excellent creep resistance at temperatures up to 1500° F. When such sheet steels are provided with an oxidation resistant metallic coating, such as an electroplated or hot-dip coating, the steels are ideally suited for use in automotive exhaust systems.

THE DRAWING

The FIGURE is a plot of test data comparing the sag deflection performance of several sheet steels according to this invention, and sheet steels of the prior art.

DETAILED DESCRIPTION OF PREFERRED EMBODIMENT

This invention is directed to the production of a cold-rolled, annealed and coated steel sheet or strip characterized by (1) a high degree of creep resistance, and (2) a composition consisting essentially of, by weight %:

| | |
|---|---|
| Carbon | 0.05–0.15 |
| Manganese | 0.50 max. |
| Phosphorus | 0.04–0.15 |
| Sulfur | 0.03 max. |
| Silicon | 0.10 max. |
| Aluminum | 0.08 max. |
| Titanium | 0.20–0.50 |
| Iron | balance* |

*except for the inclusion of normal impurities such as Cu, Ni, Cr, Mo, N, O

It was discovered during the investigation leading to this invention that a critical feature thereof was a control on the quantity and relationship of the elements Ti-P-C. It is theorized that the high degree of creep resistance exhibited by the sheet steels of this invention are related to both the precipitate density and the resistance of these finely dispersed particles to coarsening with time at temperature. Such relationship of Ti-P-C will become more apparent by the description which follows.

In the practice of this invention, a steel having the above composition, preferably where the titanium and phosphorus are present in amounts of at least 0.25% and 0.100%, respectively, may be melted and processed using conventional steel-making and processing techniques. Notwithstanding that conventional steel making practices may be followed in preparing the sheet steels of this invention, for control purposes seven laboratory heats were prepared. The compositions for such heats are listed in TABLE I as A to G. Additionally, two samples were selected from commercial heats of Type 409 and Type 316 stainless steels, respectively identified as 409SS and 316SS.

TABLE I

| Steel Sheet Sample | Composition*, Weight % | | | | | | | | | | |
|---|---|---|---|---|---|---|---|---|---|---|---|
| | C | Ti | P | S | Si | Al | Mn | Cu | Ni | Cr | Mo |
| A | 0.084 | 0.220 | 0.100 | 0.021 | 0.035 | 0.018 | 0.41 | 0.086 | 0.013 | 0.011 | 0.020 |
| B | 0.076 | 0.280 | 0.005 | 0.020 | 0.016 | 0.040 | 0.34 | 0.032 | 0.012 | 0.010 | 0.020 |
| C | 0.100 | 0.780 | 0.086 | 0.019 | 0.037 | 0.052 | 0.40 | 0.031 | 0.014 | 0.011 | 0.020 |
| D | 0.120 | 0.320 | 0.140 | 0.020 | 0.062 | 0.060 | 0.37 | 0.031 | 0.013 | 0.010 | 0.020 |
| E | 0.140 | 0.560 | 0.087 | 0.020 | 0.027 | 0.032 | 0.37 | 0.030 | 0.015 | 0.012 | 0.020 |
| F | 0.057 | 0.100 | 0.080 | 0.019 | 0.023 | 0.039 | 0.30 | 0.031 | 0.014 | 0.010 | 0.020 |
| G | 0.043 | 0.500 | 0.010 | 0.020 | 0.300 | 0.030 | 1.00 | 0.020 | 0.020 | 0.025 | 0.020 |
| 409SS | 0.026 | 0.330 | 0.019 | 0.002 | 0.700 | 0.036 | 0.32 | 0.054 | 0.350 | 11.40 | 0.073 |
| 316SS | 0.035 | 0.006 | 0.025 | 0.014 | 0.370 | 0.004 | 1.43 | 0.290 | 12.20 | 17.00 | 2.090 |

*including normal impurities, such as nitrogen and oxygen

The heats for Samples A to G were prepared by induction melting using a full-killing practice with aluminum and cast into 300 lb. ingots. The ingots were reheated to 2350° F. for two hours, then slabbed to $\frac{3}{4}$" thickness. Thereafter, the slabs were hot and cold-rolled to a thickness of 0.031".

After suitable heat treating experimentation, a batch annealing practice was selected to ensure recrystallization of the samples. The parameters of such practice include, (a) neutral to reducing atmosphere, (b) 1400° F. annealing temperature, (c) hold time at temperature of 16 hours, and (d) furnace cooling. However, while the material in its annealed state could be tested for its resistance to creep, it was deemed desirable to provide such samples with an oxidation resistant coating. Since exposure of the base steels to the 1500F sag test air environment would have resulted in rapid, catastrophic oxidation, the surfaces of the samples to be sag tested were electroplated with 0.3 to 0.5 mil of chromium.

It should be noted that other metallic type coatings, such as hot-dip coatings, for example, may be used to effectively prevent the catastrophic oxidation. The resistance to deformation of the several sheet samples at 1500° F. was determined using a sag test that was developed by Ford Motor Company identified as Engineering Material Specification ESL-M1A244-A, Paragraph 3.13. Samples ($\frac{7}{8}$"×12") of each sheet material were placed on Type 304 stainless steel racks having a spacing between supports of 10". The rack and samples were heated at 1500° F. for periods of time ranging from 1 to 96 hours and held at room temperature for about 1 hour during measurement.

The results of the sag test are graphically presented in the FIGURE. The various line graphs show deformation in a cyclic sag test as a function of cumulative time at b 1500° F. The sag deflection curves for sheet samples of this invention are Samples A, B and D, and appear with the curve for 316SS at the lower section of the FIGURE. Such samples have compositions giving sufficient precipitate density and a stabilized structure to prevent diffusion of excess titanium. They display excellent creep resistance, approaching that of 316SS. While Sample F contained the elements Ti-P-C, the titanium was below that of the present invention. As a consequence, it is believed that such Sample possessed a very low volume fraction of strengthening precipitate and therefore deformed rapidly. Initially, Sample E revealed good creep resistance but after a limited time period began to creep rapidly, probably due to precipitate coarsening. This time dependent coarsening (exacerbated by a high concentration of titanium relative to the carbon and phosphorus available to combine with it) is also the probable cause of the relatively poor performance of Sample C.

In all but one case, chromium plating improved performance. The creep resistance of the chromium plated 316SS is markedly worse than the unplated sheet. This may be due to the diffusion of chromium into the surface resulting in a partial transformation from an austenitic to a ferritic structure. Ferritic structures (BCC) are known to be inherently less creep resistant than austenitic structures (FCC).

In any case, by excluding the performance of the unplated 316SS, a highly expensive material, the only sheet samples to give satisfactory performance were A, B and D, the sheet steels of this invention. Each such steels showed a deflection of less than 20 mm over an extended time at temperature.

Examination by analytical election microscopy of typical Ti-P-C containing steels of this invention show a structure containing precipitates whose diameter ranges from about 10 to 100 nanometers. Energy dispersive X-ray spectroscopy (EDS) of these precipitates show the larger precipitates to contain both titanium and phosphorus and the smaller precipitates to contain primarily titanium, probably as titanium carbide.

I claim:

1. A cold-rolled and annealed steel sheet and strip having a high degree of creep resistance, characterized by a composition consisting essentially of by weight %,

| | |
|---|---|
| Carbon | 0.05–0.15 |
| Manganese | 0.50 max. |
| Phosphorus | 0.100–0.15 |
| Sulfur | 0.03 max. |
| Silicon | 0.10 max. |
| Aluminum | 0.08 max. |
| Titanium | 0.25–0.50 |
| Iron | balance, |

which composition is balanced within said carbon, phosphorus, and titanium ranges to give sufficient precipitate density and a stabilized structure to prevent diffusion of excess titanium, a microstructure containing finely dispersed precipitates, and a creep resistance revealing less than 20 mm deflection when subjected to a cyclic sag test identified as Ford Motor Company, Engineering Material Specification ESL-M1A244-A, Paragraph 3.13.

2. The steel sheet or strip according to claim 1 wherein said precipitates have diameters ranging between 10 and 100 nanometers.

* * * * *